US006030148A

United States Patent [19]

Törmälä et al.

[11] Patent Number: 6,030,148

[45] Date of Patent: Feb. 29, 2000

[54] METHOD FOR IMPROVING THE FEASIBILITY OF A DRILLING RIG OF JACK-UP TYPE AND A DRILLING RIG OF JACK-UP TYPE

[76] Inventors: Pasi Törmälä , Brunkom 72, FIN-10410, Aminnefors; Mikael Cande, Kuusitie 7 A 43, FIN-00270, Helsinki, both of Finland

[21] Appl. No.: 08/952,901

[22] PCT Filed: Jun. 5, 1996

[86] PCT No.: PCT/FI96/00307

§ 371 Date: Dec. 1, 1997

§ 102(e) Date: Dec. 1, 1997

[87] PCT Pub. No.: WO96/41922

PCT Pub. Date: Dec. 27, 1996

[30] Foreign Application Priority Data

Jun. 9, 1995 [FI] Finland ..... 952839
Jun. 9, 1995 [FI] Finland ..... 952840

[51] Int. Cl.[7] ..... E02B 17/08; B63B 35/44

[52] U.S. Cl. ..... 405/196; 405/197; 405/200; 405/201; 405/209; 114/121; 114/264; 114/267

[58] Field of Search ..... 405/196, 197, 405/198, 199, 200, 201, 203, 204, 205, 206, 208; 114/67 A, 121, 264, 265, 269, 85, 344

[56] References Cited

U.S. PATENT DOCUMENTS

| | | | |
|---|---|---|---|
| 3,367,119 | 2/1968 | Rybicki | 405/196 |
| 3,442,340 | 5/1969 | Christenson | 405/201 X |
| 3,461,828 | 8/1969 | Bielstein . | |
| 3,477,235 | 11/1969 | Branham et al. | 405/203 X |
| 3,688,719 | 9/1972 | Amirkian | 114/121 X |
| 3,826,099 | 7/1974 | Lovie | 405/196 |
| 4,029,036 | 6/1977 | Magnuson | 114/67 A |
| 4,161,376 | 7/1979 | Armstrong | 405/196 |
| 4,483,644 | 11/1984 | Johnson | 405/201 |
| 4,602,894 | 7/1986 | Lorez et al. | 405/203 |
| 4,658,903 | 4/1987 | Tateishi | 405/196 X |
| 4,740,108 | 4/1988 | Levee et al. . | |
| 4,898,288 | 2/1990 | Erdbrink | 114/121 X |
| 4,907,912 | 3/1990 | Smith | 405/208 |
| 5,367,973 | 11/1994 | Haggertveit | 114/85 X |

FOREIGN PATENT DOCUMENTS 952839 5/1996 Finland .

*Primary Examiner*—Eileen Dunn Lillis
*Assistant Examiner*—Jong-Suk Lee
*Attorney, Agent, or Firm*—Pollock, Vande Sande & Amernick

[57] ABSTRACT

A method and apparatus for an improved drilling rig of jack-up type is provided. The drilling rig has a frame part comprising a working deck and an essentially plane-shaped bottom. Three feet are provided in the frame and are operated by lifting devices. The feet support the frame on the sea bottom during a drilling operation and are lifted off the sea bottom when the drilling rig is transported. A drilling unit is movably arranged on the frame part and can be moved substantially outside the frame during a drilling operation. A residence unit is also provided on the frame and is movable in a direction opposite that of the drilling unit at least during the drilling operation. An air bed is blown into an airspace which is arranged below the frame part of the drilling rig. The air bed is dischargeable for transportation of the drilling rig.

15 Claims, 7 Drawing Sheets

METHOD FOR IMPROVING THE FEASIBILITY OF A DRILLING RIG OF JACK-UP TYPE AND A DRILLING RIG OF JACK-UP TYPE

FIELD OF THE INVENTION

The invention relates to a method for improving the feasibility of a drilling rig of jack-up type. The drilling rig has a frame part comprising a working deck and an essentially plane shaped bottom, inside of which there has been arranged at least a part of the power production and operating equipment of the drilling rig. In connection with the frame part there has been arranged at least three feet operated by lifting devices, by means of which the drilling rig may be supported on the sea bottom during an attachment phase through lowering the same from a standby position, required by a transportation position of the drilling rig essentially in a vertical direction with respect to the frame part, to a working position enabling at least a drilling function and detached from the sea bottom during a detachment phase through lifting the feet upwardly with respect to the frame part, and a drilling unit for drilling. The drilling unit is moveable essentially in a horizontal plane with respect to the frame part by means of a first transferring arrangement, such as by actuators driven electricity, pressurized medium and/or correspondingly and a slide rail assembly or a like, to perform the drilling during the drilling situation essentially from outside the frame part. An air-bed or a like known as such is being blown below the frame part of the drilling rig by means of a blow arrangement at least to eliminate strokes directed from the sea level to the bottom of the frame part.

BACKGROUND OF THE INVENTION

In the above use it is nowadays known to use so called semi-submersible drilling rigs and the type of jack-up drilling rigs as described above. The above drilling rigs differ from each other in such respect, that semi-submersible drilling rigs comprise an underwater part, which supports the actual working deck existing on the sea level.

Such a drilling rig is not supported stationary on the ground at all during a drilling function, that is why the type of drilling rig requires expensive and complicated joint and movement arrangements between the drilling device drilling the ground and the drilling rig, which enable drilling despite the roll of the sea. Both the costs of manufacturing and operating of such type of drilling rigs are multiple, when compared to drilling rigs of jack-up type described above. One crucial advantage of the type of drilling rigs above compared to nowadays drilling rigs of jack-up type is, however, that because of the massive construction of the same they may be transported in most heterogeneous circumstances, even during a relatively high roll of the sea. In addition to that, they may be used at clearly deeper water, than jack-up rigs, which may be used when the depth of water is usually below 150 m.

Presently many problems are involved with a typical drilling rig of jack-up type, though it has certain significant advantages particularly when compared to those drilling rigs of semi-submersible type described above. First of all it is significantly cheaper to manufacture and to use, since, that the drilling rig of jack-up type is attached stationary on the sea bottom during the drilling situation. This is why complicated joint and movement arrangements are not needed, because the drilling unit drilling the ground does not move significantly with respect to the frame of the drilling rig during the drilling situation. However certain problems are involved with the type of nowadays drilling rigs, that is why they are not safe enough in practice and not useable even during usual circumstances that are characteristic to certain operational areas.

First of all the type of drilling rig may not be safely transported, when the height of the waves is more than 2 m. This is due to the flat shape of the bottom of the frame part, whereby the waves, particularly during a so called transito-phase that is, when the frame part is rising above the sea level when the drilling rig is supported on the sea bottom or respectively when it is lowered on the sea level, when the drilling rig is detached from the sea bottom, hitting the same may cause damages to the frame part and to the devices and equipment placed inside the same. The flatness of the bottom is based on its part on that, that the type of drilling rigs are transported to their operating sites either being towed by towing ships or more commonly transported on the deck of a transporting ship. On the other hand the type of drilling rigs are equipped usually with only three feet to minimize the manufacturing costs, which is the reason why an efficient working deck fitting the same is relatively small. This naturally makes functioning on the drilling rig difficult. In addition, this type of drilling rigs are not considered safe enough in practice since the small size of the drilling rig the residence unit is situated always relatively close by the drilling unit performing the drilling.

This is why despite the advantages of drilling rigs of jack-up type, these advantages rigs may not be exploited with nowadays constructions efficiently enough, not even during usual operating circumstances, that are typical to certain areas, at which the use of the jack-up drilling rig would be otherwise idealistic or clearly more advantageous than the use of a drilling rig of semi-submersible drilling rig described above.

On the other hand for example from U.S. Pat. No. 3,461,828 it is previously known particularly in connection with the semi-submersible drilling rig to blow air below the frame part of the drilling rig to eliminate strokes directed from the sea level towards the bottom of the frame part. The solutions disclosed in this patent are stationary, fixed constructions, which thus may not be particularly adapted in connection with jack-up type drilling rigs, because the bottom of such type of a drilling rig has to be a uniformly flat surface particularly to enable the transportation of the same transferring to the operating site. Though the air-bed being used for example in connection with the US-patent above is meant in principle to eliminate the strokes of the sea level to bottom of the frame part, this matter has a totally different meaning in practice in connection with a drilling rig of jack-up type, because in this connection the type of air-bed arrangement is needed particularly during a so called transito-phase only, that is at that stage, when the frame part rises above the sea level, when the drilling rig is supported on the sea bottom or correspondingly when it lowers on the sea level, when the drilling rig is detached from the sea bottom. This situation is dangerous particularly for a drilling rig of jack-up type, which in practice significantly limits the use of nowadays drilling rigs of jack-up type.

SUMMARY OF THE INVENTION

It is the aim of the method for improving the feasibility of a drilling rig of jack-up type according to this invention to achieve a decisive improvement in the problems presented above and thus to raise substantially the level of knowledge in the field. To achieve this aim, the inventive method is primarily characterized in, that, to improve the feasibility of the drilling rig, and particularly the safety of the attachment phase and/or the detachment phase, below the bottom of the frame part there has been arranged an air space, that is dischargeable for the transportation position of the drilling rig and into which air is blown to achieve an air-bed or a like particularly for the time of the attachment and/or the detachment phase.

The method according to this invention significantly improves the feasibility of a jack-up type drilling rig, whereby an extremely efficient drilling techniques in principle is made possible, allowing is the use of a drilling rig, that is to be supported stationary on the sea bottom in a way, that is significantly more efficient and versatile compared to nowadays drilling rigs of corresponding type and which secures adequate safety of the crew. Through blowing air into the air space below the drilling rig the use of drilling rigs of this type is enabled in difficult circumstances, that are typical to certain areas, in which the roll of the sea is almost always too big for nowadays drilling rigs of corresponding type. As an advantageous embodiment of the drilling rig the three or four feet belonging to the same are placed at the corners of the drilling rig, and the deck space of the drilling rig is as big as possible both during the attachment and detachment phases as well as during an actual drilling situation. The air space that is arranged according to the method below the bottom of the frame part during the attachment and the detachment phases is dischargeable for the transportation position, which enables the transportation of the drilling rig by traditional ways. Due to the above method it is further possible to make the use of the drilling rig more efficient in such a way, that at the same time the residence unit belonging to the same is movably arranged preferably at least partly outside the drilling rig. In addition to psychological factors this matter has also concrete influence on improving the efficiency of the use of the drilling rig, because when the residence unit moves efficiently also more deck space is simultaneously freed as a working area.

With the aid of the invention it is possible in a simple and reliable way to carry out a drilling rig construction of jack-up type, which operates with idealistic drilling techniques so, that it may be supported stationary on the sea bottom. The drilling rig according to the invention is significantly more useful than those corresponding nowadays drilling rigs particularly with a view of the safety of the attachment phase and the detachment phase. The air space arranged below the frame part, that is dischargeable for the transportation position, may be carried out with an extremely simple and reliable bottom structure of the frame part, whereby the lifting devices moving the feet are placed advantageously for example below the frame part. The drilling rig according to the invention is also much better balanced than those nowadays drilling rigs particularly during a drilling operation by arranging in addition to the drilling unit, also the residence unit belonging to the same moveable outside the drilling rig. As a result the drilling rig is significantly better balanced as a whole than nowadays drilling rigs both during transportation and drilling because during the drilling operation, when the drilling unit is outside the drilling rig, also the residence unit is outside at the opposite side. The moveability of the residence unit away from the drilling unit increases the safety of the crew, and brings concrete additional space at the working deck of the frame part.

BRIEF DESCRIPTION OF THE DRAWINGS

In the following description, the invention is illustrated in detail with reference to the appended drawings. In the drawings, FIG. 1*a* shown seen from above an advantageous drilling rig applying the method according to the invention during the transportation.

DETAILED DESCRIPTION OF THE PREFERRED EMBODIMENT(S)

Figure 1A:
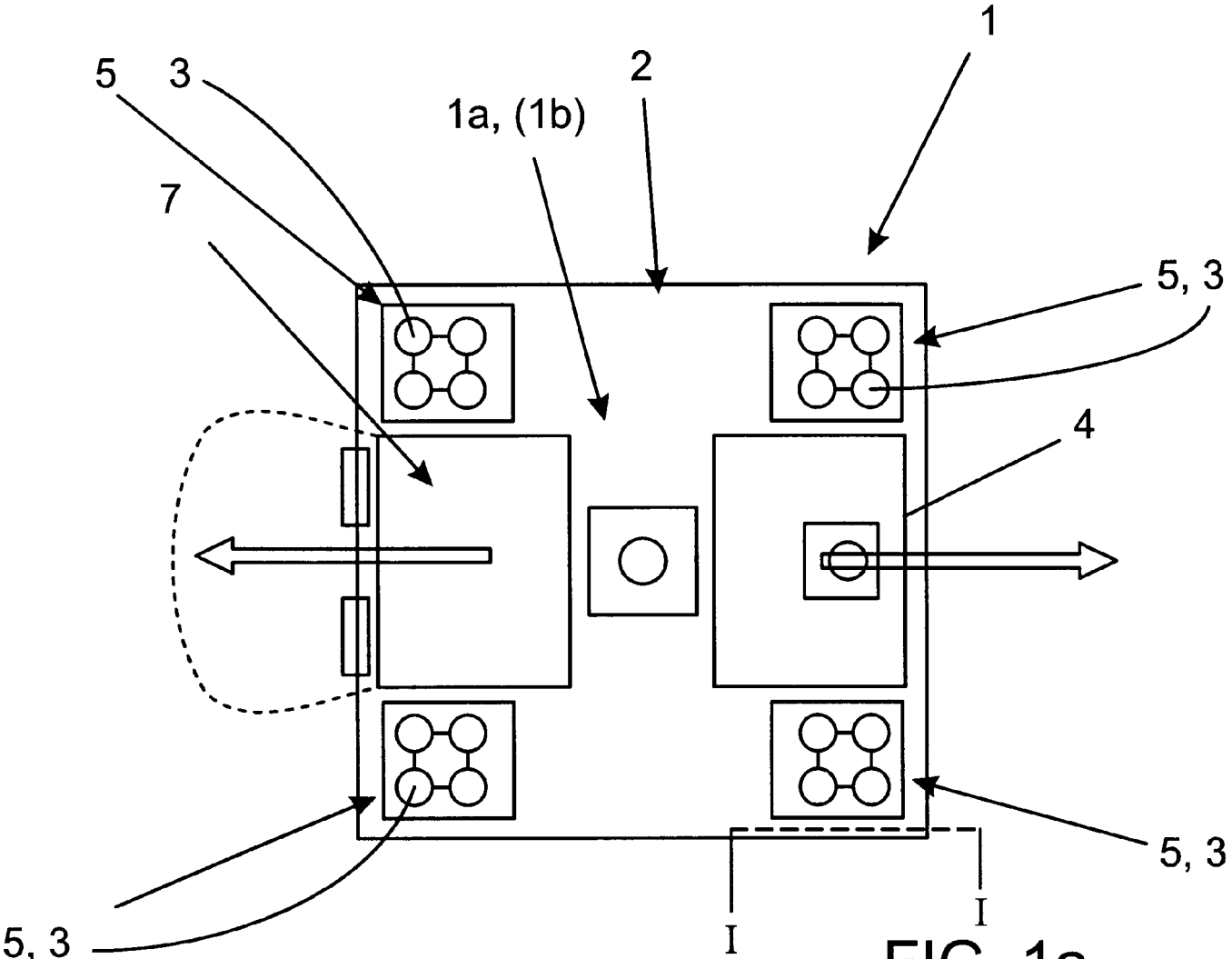
FIG. 1*b* shows the corresponding embodiment during a drilling operation.

The invention relates to a method for improving the feasibility of a drilling rig of jack-up type. The drilling rig 1 has a frame part 2 comprising a working deck 1*a* and an essentially plane shaped bottom 1*b*, inside of which there has been arranged at least a part of the power production and operating equipment of the drilling rig 1. In connection with the frame part 2 there has been arranged at least three feet 3 operated by lifting devices 5, by means of which the drilling rig 1 may be supported on the sea bottom during an attachment phase through lowering the same from a standby position required by a transportation position of the drilling rig 1 essentially in a vertical direction with respect to the frame part 2 to a working position enabling at least a drilling operation and detached from the sea bottom during a detachment phase through lifting the feet 3 with respect to the frame part 2 upwards, and a drilling unit 4 for drilling. The drilling unit 4 is arranged to be essentially in a horizontal plane with respect to the frame part 2 by means of a first transferring arrangement 6, such as by actuators driven by electricity, pressurized medium and/or correspondingly and a slide rail assembly or a like, to perform the drilling during the drilling operation essentially from outside the frame part 2. An air-bed or a like known as such is being blown below the frame part of the drilling rig by means of a blow arrangement 10*b* at least to eliminate strokes directed from the sea level to the bottom of the frame part. To improve the feasibility of the drilling rig 1, particularly with a view to the safety of the attachment phase and/or the detachment phase, below the bottom 1*b* of the frame part there has been arranged an air space 10*a*, that is dischargeable for the transportation position of the drilling rig and into which air is blown to achieve an air-bed or a like particularly for the time of the attachment phase and/or the detachment phase.

Figure 1B:
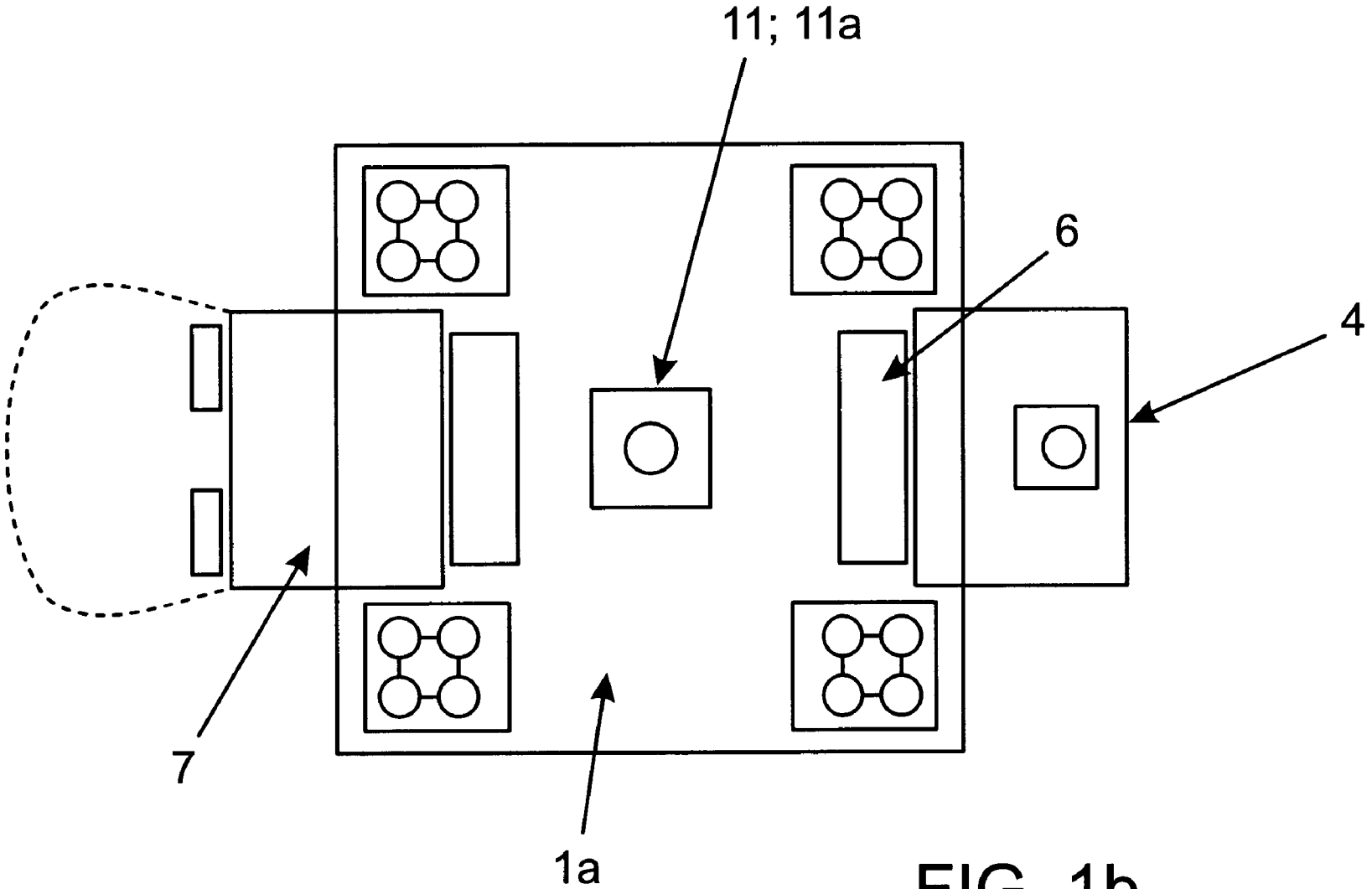
Figure 2:
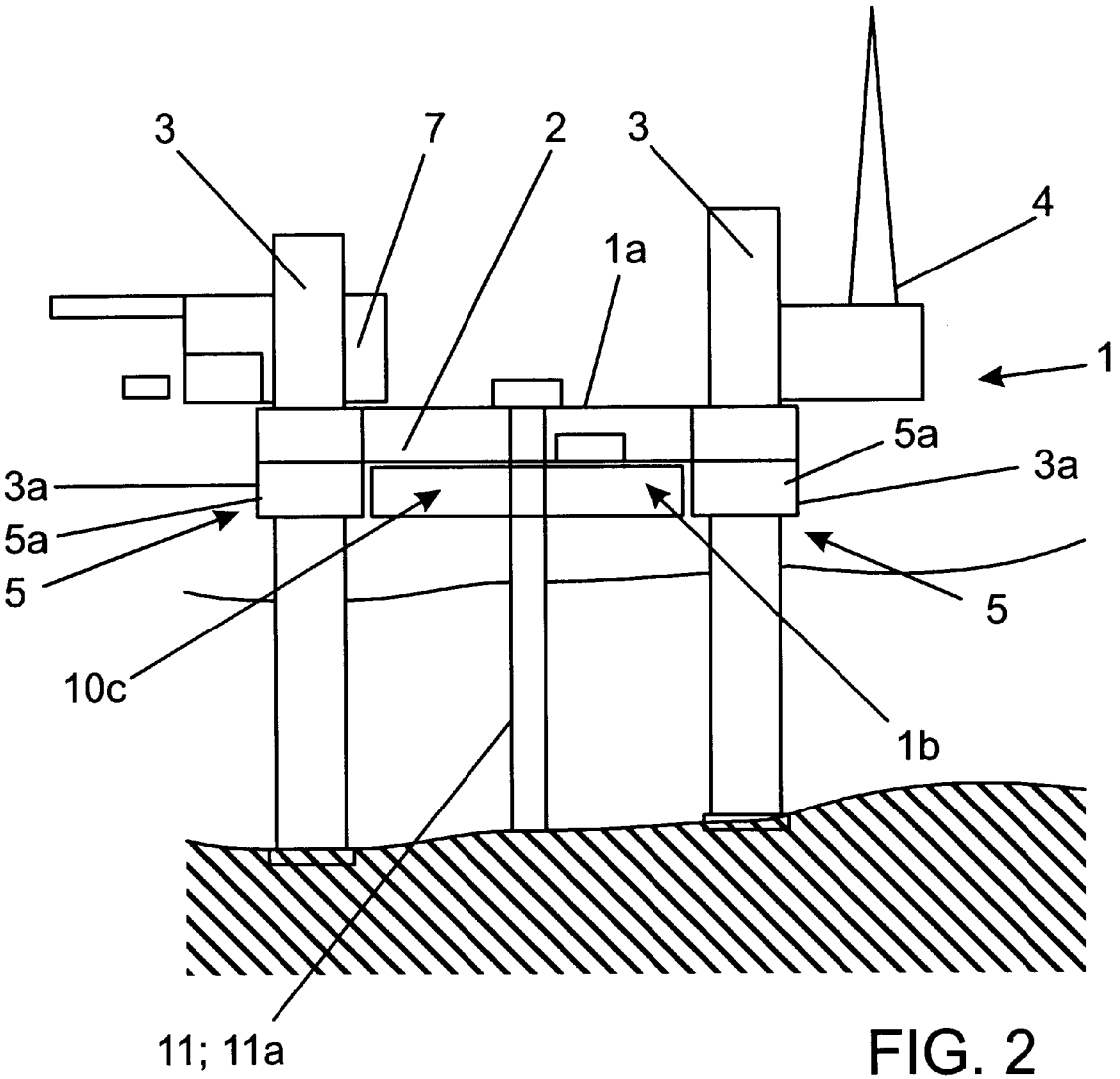
FIG. 2 shows the corresponding drilling rig during a drilling operation as a sideview.

A drilling rig using the method according to the invention is illustrated in FIG. 1*a* during transportation position, whereby both the drilling unit 4 and a residence unit 7 are totally above the frame part 2. In FIGS. 1*b* and 2 there has been shown correspondingly a drilling situation, whereby as an advantageous embodiment of the method the residence unit 7 and the drilling unit 4 are moved advantageously partly outside the frame part 2 particularly to increase the useable, free space on the working deck 1*a* of the frame part 2.

Further as an advantageous embodiment of the method, the drilling rig 1 comprises feet 3, that are placed at the corners of the frame part 2, whereby the air space 10*a* is being opened/discharged through moving the wall structures 10*c*, that are advantageously moveable against support structures 3*a* placed in connection with the said feet 3, from an essentially vertical position to an essentially horizontal position. In this way an ideal construction of the drilling rig is enabled, whereby it may be transported from one operating site to another with traditional transporting arrangements thanks to the bottom of the same being still essentially flat.

Further as an advantageous embodiment, the bottom 1*b* of the frame part is being reinforced through an auxiliary support assembly 11, such as a deep water pipe 11*a*, auxiliary drilling unit and/or a like, by means of which essentially the central part of the bottom 1*b* of the frame part is supported stationary on the sea bottom at least during a drilling situation. Due to this it is possible to increase the stiffness of the significantly wide bottom surface, enabled by the construction in question, particularly in extremely difficult circumstances.

Particularly to improve the safety and feasibility of the drilling rig 1, the method may thus be carried out so, that the residence unit 7 is arranged movably as described above, whereby it is being transferred at least for the time of the drilling operation essentially away from the drilling unit 4, advantageously at least partly outside the frame part 2 of the drilling rig 1 to increase the free working deck space of the frame part 2 useable during the drilling situation.

Figure 3:
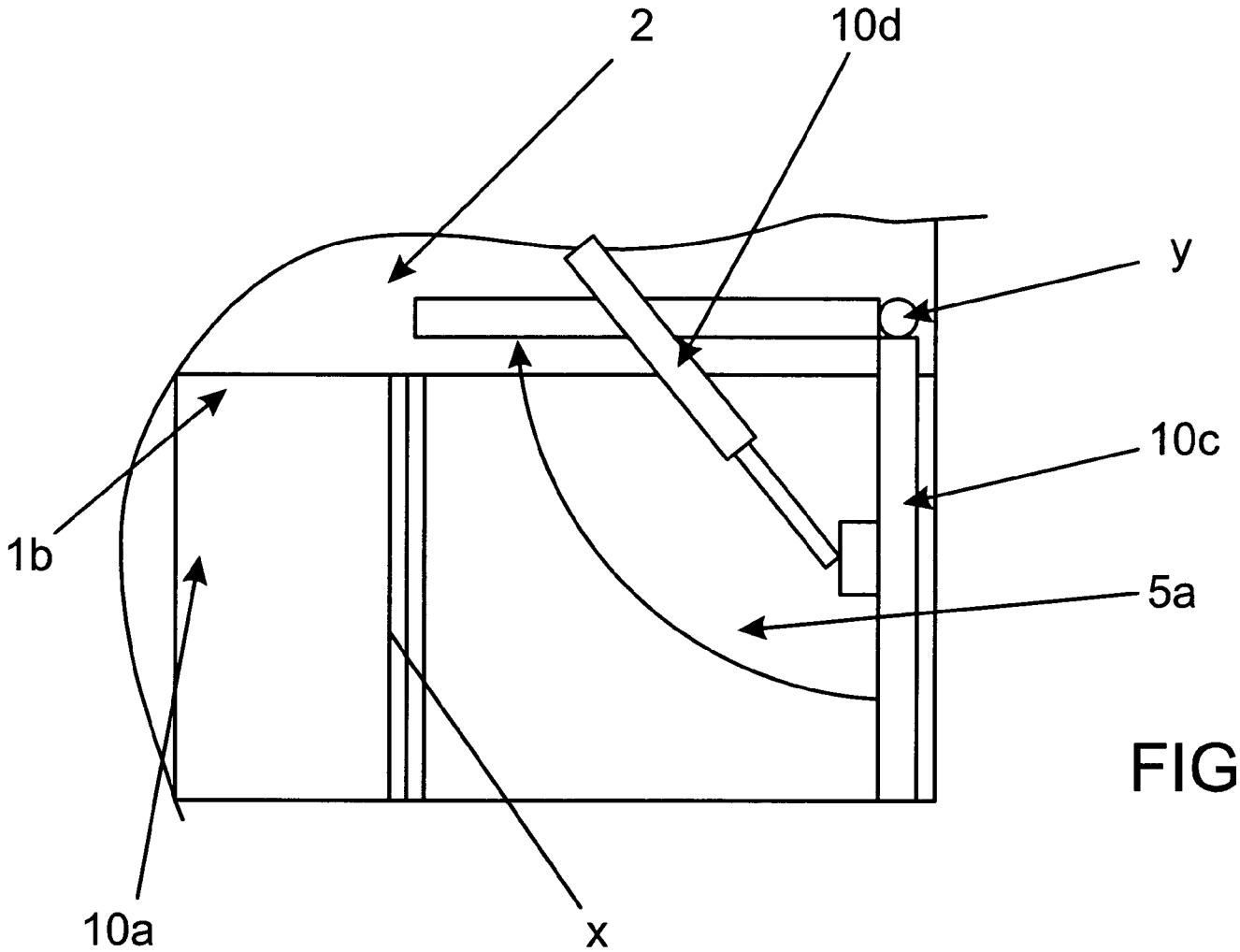
FIG. 3 is a sectional view taken along line I—I in FIG. 1*a* and shows an advantageous wall structure arrangement that forms a dischargeable air space.

An advantageous drilling rig 1 of jack-up type applying the method according to the invention is represented in FIGS. 1*a*–5 in principle, whereby to improve the feasibility of the drilling rig 1, particularly the safety of the attachment phase and/or the detachment phase, below the bottom 1*b* of the frame part there has been arranged an air space 10*a*, that is dischargeable for the transportation position of the drilling rig, to achieve an air-bed or a like particularly for the time of the attachment phase and/or the detachment phase, which principle may be found for example from FIGS. 2 and 3.

As an advantageous embodiment, the drilling rig 1 comprises feet 3, that are placed essentially at the corners of the frame part 2, whereby the air space 10*a* is arranged to be opened/discharged through moving the wall structures 10*c*, that are moveable essentially against support structures 3*a* placed in connection with the feet 3, to an essentially vertical position to an essentially horizontal position as shown in FIG. 3.

Further as an advantageous embodiment particularly with reference to FIG. 2, the bottom 1*b* of the frame part is reinforced through an auxiliary support assembly 11, such as a deep water pipe 11*a*, auxiliary drilling unit and/or a like, by means of which essentially the central part of the bottom 1*b* of the frame part is to be supported stationary on the sea bottom at least during a drilling situation. Due to the significantly wide bottom surface of the bottom of the frame part is furthermore reinforced particularly in extremely difficult circumstances.

As shown for example in FIGS. 2 and 3, the lifting devices 5 for moving the feet 3 are arranged in lifting device rooms 5*a* placed underneath the frame part 2 and acting, as shown in FIG. 3, as support structures 3*a* forming the air space 10*a* in cooperation with the wall structures 10*c*. The air space 10*a* has an open lower end portion which faces the sea. By placing the lifting device rooms 5*a* underneath the frame part 2, the efficient working deck space of the frame part has been increased simultaneously.

As shown particularly in FIG. 3, the wall structures 10*c* comprise plate structures, sheet structures or the like, that are connected from the top moveably, such as by a joint, a hinge and/or a like in connection to the frame part 2 and the side edges x of which are arranged to touch continuously the counterpart surfaces of the support structures 3*a*, while the wall structures 10*c* are moving, and the wall structures 10*c* being arranged operated by means of an actuator arrangement 10*d*, that is arranged yieldable by influence of stroke energy of the waves.

Figure 4A:
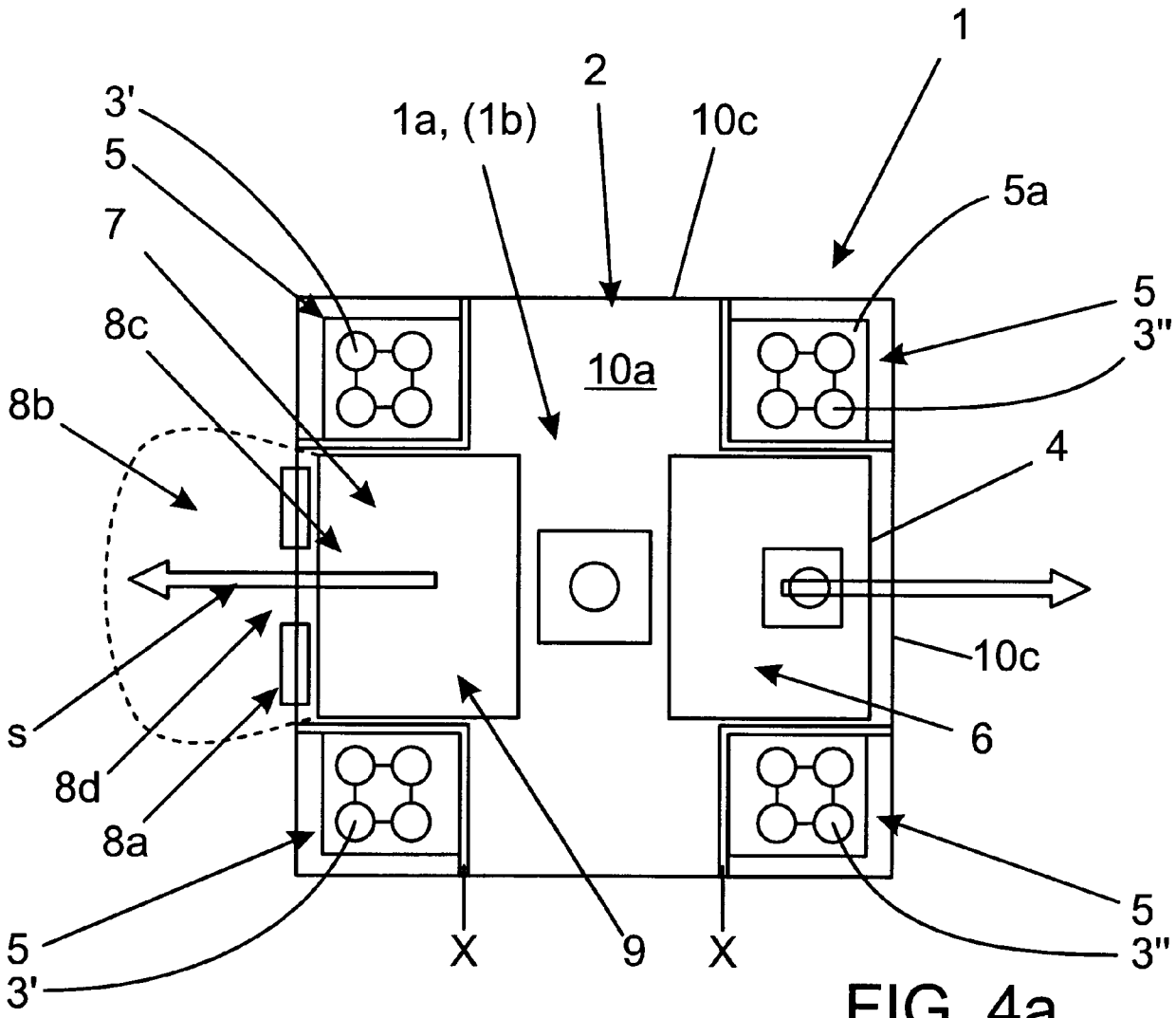
FIG. 4*a* shows an advantageous principle of the method according to the invention during transportation as seen from above.
Figure 4B:
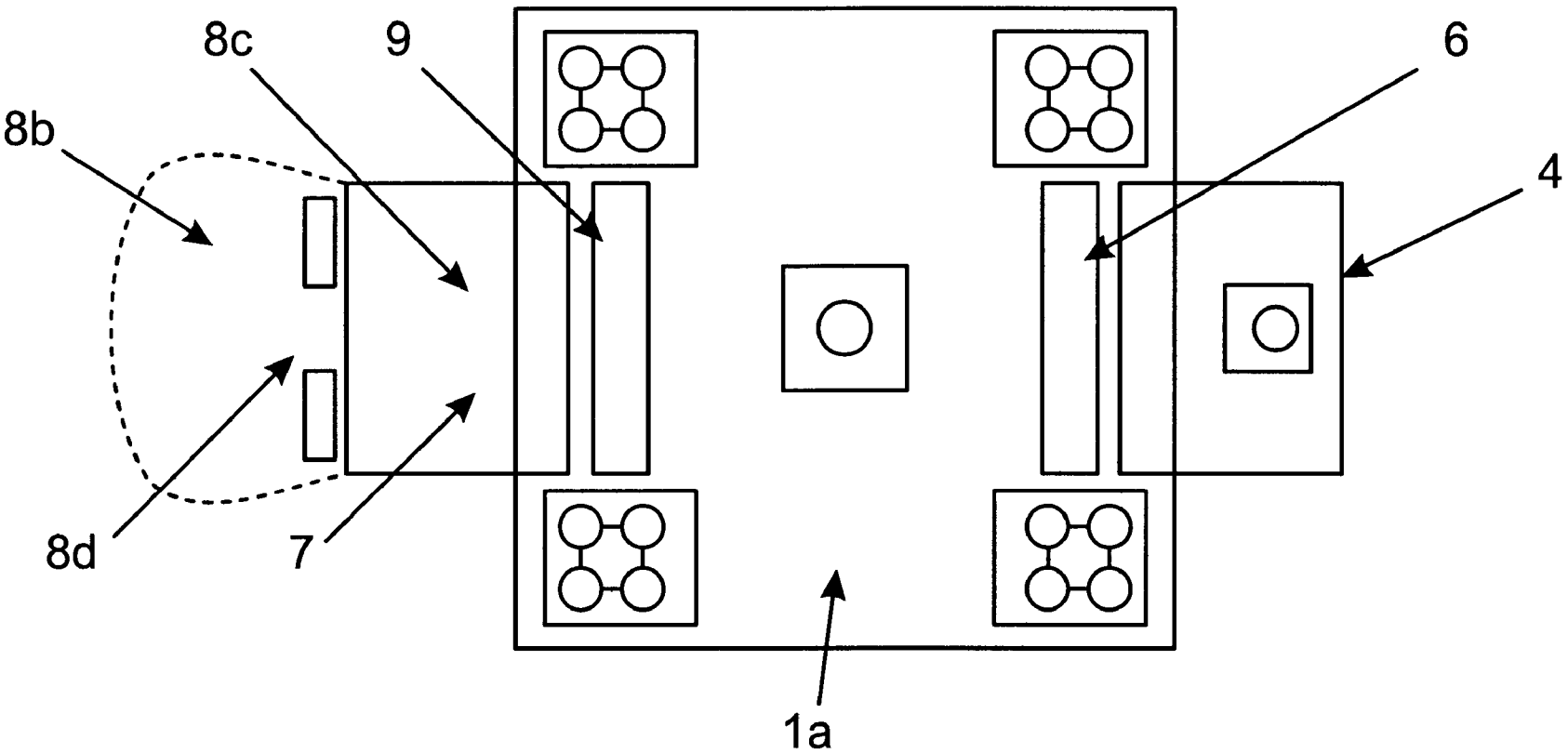
FIG. 4*b* shows the corresponding embodiment as a similar view during a drilling operation and FIG. 5 shows the drilling rig as shown in FIGS. 4*a* and 4*b* during a drilling operation as a side view.
Figure 5:
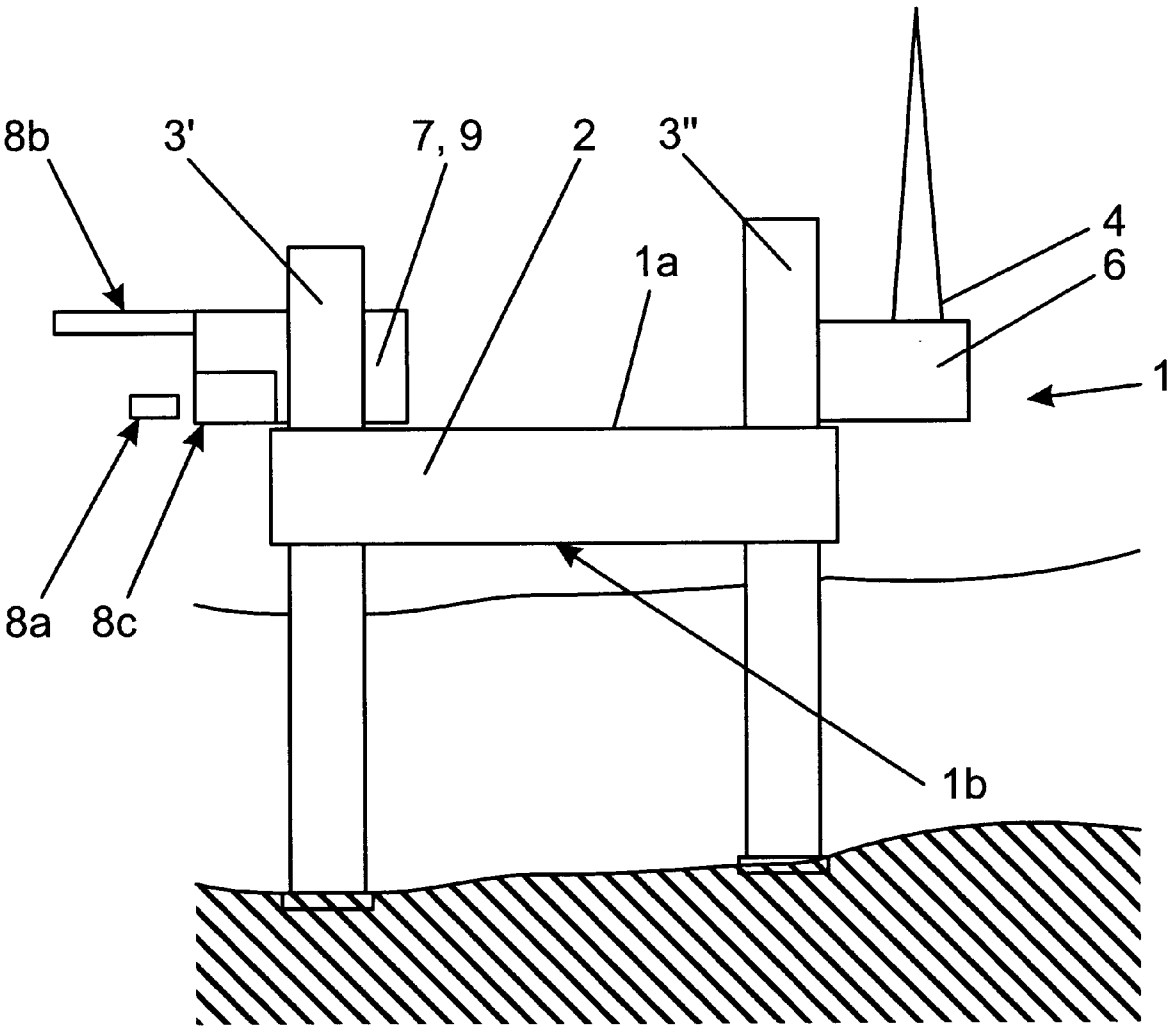

Further an advantageous drilling rig 1 of jack-up type applying the method according to the invention is represented in FIGS. 4*a*, 4*b* and 5 in principle, in which the residence unit 7 is moveable by means of a second transferring arrangement 9 to transfer the residence unit 7 essentially away from the drilling unit 4 partly outside the drilling rig, by moving the same advantageously in a direction opposite to the moving direction of the drilling unit 4. This has been carried out in the presented embodiment by arranging four feet 3 on the frame part of the drilling rig, placed at the corners of the same, whereby the movement of the residence unit 7 is enabled further between the pair of feet 3' placed opposite to the pair of feet 3 " in connection with the drilling unit 4 in a totally opposite direction essentially outside the frame part 2. With reference to FIG. 5 in connection to the moveable residence unit 7 there has been arranged an emergency exit 8*c*, that is at least partly shut, through which the exit of the crew from the drilling rig 1 is enabled in a way essentially protected from the surroundings. By arranging for example a helicopter deck 8*b* advantageously in connection of the top with the residence unit 7, it is possible to place the life boats below the same in such a way that further a covered protecting space 8*d* is achieved to protect the passing of the crew to the life boats 8*a*.

Further as shown in FIG. 5, in connection with the residence unit 7 there has been arranged built in a protected emergency exit space 8*c* and a covered protect space 8*d*, to enable exit of the crew to the sea below the space 8*c*/8*d* through getting down by means of one or several ladders, slides and/or correspondingly. As an advantageous embodiment the emergency exit space 8*c* and/or the protect space 8*d* is placed essentially at the lower edge of a part of the moveable residence unit 7, that moves outside the frame part 2.

It is obvious, that the invention is not limited to the embodiments described above, but it can be modified within the basic idea even to a great extent. Thus a method according to the invention may be exploited technically with very many types of constructions and bottom shapes of the drilling rig. In addition to that, it is naturally possible to equip the drilling rig more abundantly than shown above by adapting for example a usual propeller arrangement in connection with the drilling rig, that enables independent moving of the drilling rig, and for example anchoring arrangements and so on.

We claim:

1. A method of improving the feasibility of a jack-up drilling rig, said drilling rig comprising a frame with a working deck and a substantially plane shaped bottom, at least a part of power production and operating equipment being arranged in said frame; at least three feet provided on said frame, said feet being arranged to move vertically with respect to said frame by means of lifting devices between a standby position in which said feet are elevated for transportation of said drilling rig and a working position in which said feet support said frame on the sea bottom; a drilling unit provided on said frame, said drilling unit being moveable in a horizontal direction with respect to said frame between a transportation position wherein said drilling unit is substantially above said frame and a drilling position wherein said drilling unit is substantially outside said frame; and a blow arrangement, said method comprising the steps of:

providing an air space, defined by side walls and an open lower end portion, below said plane shaped bottom;

filling said air space with air via said blow arrangement to form an air-bed, at least when said feet are moving;

discharging said air space for transporting said drilling rig.

2. A method according to claim 1 further comprising the step of:

providing said feet at essentially corners of said frame;

discharging said air space by moving said walls against support structures placed in connection with said feet.

3. A method according to claim 1 further comprising the step of:

supporting said frame through an auxiliary support arranged between roughly the center of said frame and the sea bottom, at least during drilling.

4. A method according to claim 3 wherein said auxiliary support is an auxiliary drilling unit.

5. A method of improving the function of a jack-up drilling rig, said drilling rig comprising a frame with a working deck and a substantially plane shaped bottom, at least a part of power production and operating equipment being arranged in said frame; at least three feet provided on said frame, said feet are arranged to move vertically with respect to said frame by means of lifting devices between a standby position in which said feet are elevated for transportation of said drilling rig and a working position in which said feet support said frame on the sea bottom; a drilling unit provided on said frame, said drilling unit being moveable in a horizontal direction with respect to said frame between a transportation position wherein said drilling unit is substantially above said frame and a drilling position wherein said drilling unit is substantially out side said frame; a residence unit located on said frame and a helicopter deck connected to said residence unit, said method comprising the step of:

providing an emergency exit at a lower edge of said residence unit; and moving said residence unit comprising said helicopter deck away from said drilling unit, at least during drilling, such that said emergency exit moves outside said frame.

6. A method according to claim 5 wherein said residence unit is moved at least partially outside said frame.

7. A method according to claim 5 wherein said residence is moved in an opposite direction with respect to a direction of movement of said drilling unit into said drilling position.

8. A jack-up drilling rig comprising:

a frame with a working deck and a substantially plane shaped bottom, at least a part of power production and operating equipment being arranged in said frame;

at least three feet provided on said frame, said feet are arranged to move vertically with respect to said frame by means of lifting devices, said feet are moveable from a standby position in which said feet are elevated for transportation of said drilling rig and a working position in which said feet support said frame on the sea bottom;

a drilling unit provided on said frame, said drilling unit being moveable in a horizontal direction with respect to said frame, said drilling unit moveable from a transportation position substantially above said frame and a drilling position substantially outside said frame;

a blow arrangement;

an air space, defined by side walls and an open lower end portion, arranged under said plane shaped bottom, said air space being dischargeable during said transportation phase and inflatable via said blow arrangement to form an air bed at least during movement of said feet.

9. A drilling rig according to claim 8 further comprising:

said feet being arranged approximately at corners of said frame and support structures arranged in connection with said feet, wherein said walls are moveable against said support structures to discharge said air space.

10. A drilling rig according to claim 9 further comprising:

lifting device rooms attached underneath said frame part, each said lifting device room being associated with one lifting device, said lifting device rooms act as said support structures and define said air space in cooperation with said walls.

11. A drilling rig according to claim 8 wherein said walls are movably attached at a top to said frame whereby said walls may move from a substantially horizontal position to a substantially vertical position, wherein side edges of said wall continuously touch said support structures.

12. A drilling rig according to claim 8 further comprising an auxiliary support part connected to roughly a center of said plane shaped bottom and arranged to be stationary on the sea bottom at least during drilling.

13. A jack-up drilling rig comprising:

a frame with a working deck and a substantially plane shaped bottom, at least a part of power production and operating equipment being arranged in said frame;

at least three feet provided on said frame, said feet are arranged to move vertically with respect to said frame by means of lifting devices, said feet are moveable from a standby position in which said feet are elevated for transportation of said drilling rig and a working position in which said feet support said frame on the sea bottom;

a drilling unit provided on said frame, said drilling unit being moveable in a horizontal direction with respect to said frame between a transportation position wherein said drilling unit is substantially above said frame and a drilling position wherein said drilling unit is substantially outside said frame;

a residence unit having an emergency exit arranged at a lower edge, said residence unit being movable in a direction away from said drilling unit, at least during drilling, whereby said emergency exit is moved outside said frame; and a helicopter deck connected to said residence unit and being movable in connection with said residence unit.

14. A drilling rig according to claim 13 wherein said residence unit is moveable in a horizontal direction with respect to said frame which is an opposite direction with respect to said movement of said drilling arrangement into said drilling position.

15. A drilling rig according to claim 13 wherein said residence unit is moved at least partially outside said frame.

* * * * *